United States Patent [19]

Coker et al.

[11] 4,093,214

[45] June 6, 1978

[54] DUAL FUNCTION EXERCISE MACHINE

[75] Inventors: Charles Milton Coker, Huntington Beach; Cliff James Coker, Calabasas, both of Calif.

[73] Assignee: Paramount Health Equipment Corp., Los Angeles, Calif.

[21] Appl. No.: 767,411

[22] Filed: Feb. 10, 1977

[51] Int. Cl.[2] ..... A63B 21/06

[52] U.S. Cl. ..... 272/118; 272/DIG. 4; 272/143

[58] Field of Search ..... 272/118, 122, 117, 135, 272/143, 144, 116

[56] References Cited

U.S. PATENT DOCUMENTS

| | | | |
|---|---|---|---|
| 374,496 | 1/1887 | Reach | 272/118 |
| 3,627,315 | 12/1971 | Marcyan | 272/118 |
| 3,635,472 | 1/1972 | Marcyan | 272/118 |

FOREIGN PATENT DOCUMENTS

| | | | |
|---|---|---|---|
| 524,962 | 5/1956 | Canada | 272/118 |

*Primary Examiner*—William R. Browne

[57] ABSTRACT

A dual function exercise machine, enabling unilateral and bilateral exercise of a limb, includes a pair of lever arms pivotally mounted adjacent to each other on a frame. Each lever arm is slidably mounted through a separate linear bearing sleeve at a point remote from the pivot point and is associated with a separate and independent stack of weights. Each weight stack is slidably mounted on guide bars of the frame. Each sleeve is pivotally connected to a selector bar which is adapted to connect a number of weights to the sleeve to provide resistance during either unilateral or bilateral exercise of a limb. In this manner, one or both corresponding limbs may be exercised with the same or different number of weights connected to each lever arm.

4 Claims, 3 Drawing Figures

DUAL FUNCTION EXERCISE MACHINE

BACKGROUND OF THE INVENTION

The present invention relates to a dual function exercise machine and, more particularly, to a device for enabling unilateral and bilateral exercise of opposing or corresponding limbs.

Typically, prior art exercising machines provided means for bilateral exercising only. A bilateral exercise is one wherein the opposing limbs apply a force to the same lifting mechanism and move in the same direction at the same rate throughout the entire exercise stroke. Such bilateral exercise machines do not permit maximum development of strength in each limb since when performing exercises bilaterally, only the then dominant limb is functioning at maximum force. For example, if a person trains bilaterally to do a 300 pound bench press, he cannot necessarily lift 150 pounds with each arm.

This problem can be overcome by unilateral training where each arm is trained separately to lift 150 pounds. An athlete who trains each arm separately to lift 150 pounds would have sufficient strength to lift more than 300 pounds using both arms together.

Bilateral training devices are further deficient in that they do not permit training in a natural pattern of movement. In most athletic activities, one limb initates the movement or direction of force, and before it completes the full range of movement, the opposite limb begins the same or similar pattern of movement. For example, in throwing a shotput, broadjumping or pitching a baseball, one limb moves in one direction while the opposing limb moves in the opposite direction. In addition, one limb accelerates while the opposing limb decelerates. Bilateral exercise does not allow training in this natural pattern of movement. However, by training unilaterally, the athlete is able to maximize strength in the limbs and to condition them to perform in the same neuromuscular pattern of movement in which corresponding athletic activities are performed.

If a bilateral device is employed to exercise one limb at a time, besides the inconvenience of changing the weights constantly the user's balance will be shifted to require the user to assume an abnormal position.

Bilateral exercise devices are also inefficient for purposes of rehabilitating an injured limb. Exercising using bilateral devices to rehabilitate an injured limb is usually a very time consuming process since the injured limb cannot contribute much force to the single weight which both the injured and non-injured limb lift. Research has proven that conditioning one limb automatically increases the strength and size in the opposite limb. This effect is known as "cross extensor reflex". In administering therapy to an injured limb, training the noninjured limb provides an automatic neuromusclar transfer of strength to the injured limb. The injured limb therefore proportionately gains in strength and size. This "cross extensor reflex" therefore permits rapid rehabilitation of the injured limb. However, bilateral devices will not permit separate and simultaneous loading of each limb to provide this more rapid rehabilitation. The unilateral machine of this invention, on the other hand, allows the non-injured limb to exercise at maximum capacity while the injured limb is simultaneously exercised at its maximum but lesser capacity.

SUMMARY OF THE INVENTION

The present invention provides an exercise machine having a plurality of separate and independent lever arms pivotally connected to a frame. A plurality of separate and independent stacks of weights are each slidably mounted on the frame and each stack is associated with one of the lever arms. Securing means are provided to secure a selected number of weights in a stack of weights to each associated lever arm.

BRIEF DESCRIPTION OF THE DRAWINGS

In the drawings which constitute part of this specification, an exemplary embodiment demonstrating various features of this invention is set forth wherein.

DESCRIPTION OF THE PREFERRED EMBODIMENT

The present invention provides a dual function exercise machine enabling unilateral and bilateral exercise of opposing limbs. A pair of lever arms 12 and 14 are associated with a separate weight stack 16 and 18, respectively, to provide separate and independent exercise, or simultaneous and independent exercise, of opposing limbs with different or the same weight. This permits maximum exercising of each limb. Since the dominant limb has a maximum capacity which is greater than the non-dominant limb, the present invention permits the dominant limb to be loaded with a greater force than the non-dominant limb. Thereafter, the present invention provides more efficient exercising of opposing or corresponding limbs in a natural rhythm of movement while the exerciser maintains a natural balance.

The present invention is particularly useful in training for athletic activities where opposing limbs move in opposite directions simultaneously. This invention permits opposing limbs to move in opposite directions and at the same time to be loaded with different resistive forces to simulate the body movement and capacity during the athletic activity. This type of training cannot be performed on machines which permit only bilateral movement.

The unilateral training device of the present invention also prevents instability caused by bilateral training devices. In the use of bilateral training devices, changes in posture and changes in the center of gravity often contribute to movement of the lever arms. This causes the forces exerted by opposing limbs against the bilateral lever arm to be unequal. Under such circumstances, the dominant limb may train at its maximum capacity but the non-dominant limb will not be trained at its maximum capacity. This lack of equalization of forces applied by the user against opposing limbs is avoided by loading opposing limbs with separate and independent resistive forces equal to the maximum capacity of each limb.

The unilateral feature of the present invention further permits rapid rehabilitation of an injured limb by exercising the non-injured limb in accordance with the phenomenon known as the "cross extensor reflex" described above. A person having an injured limb may select a relatively light resistance for the injured limb and a relatively heavy resistance for the opposing non-injured limb. Since conditioning of the non-injured limb automatically increases the strength in the injured limb, training using the present invention reduces the amount of time required to rehabilitate the injured limb.

The present invention also provides for increased resistance during the exercise stroke. This provides constant maximum muscular involvement during the range of movements of each limb.

Figure 1:
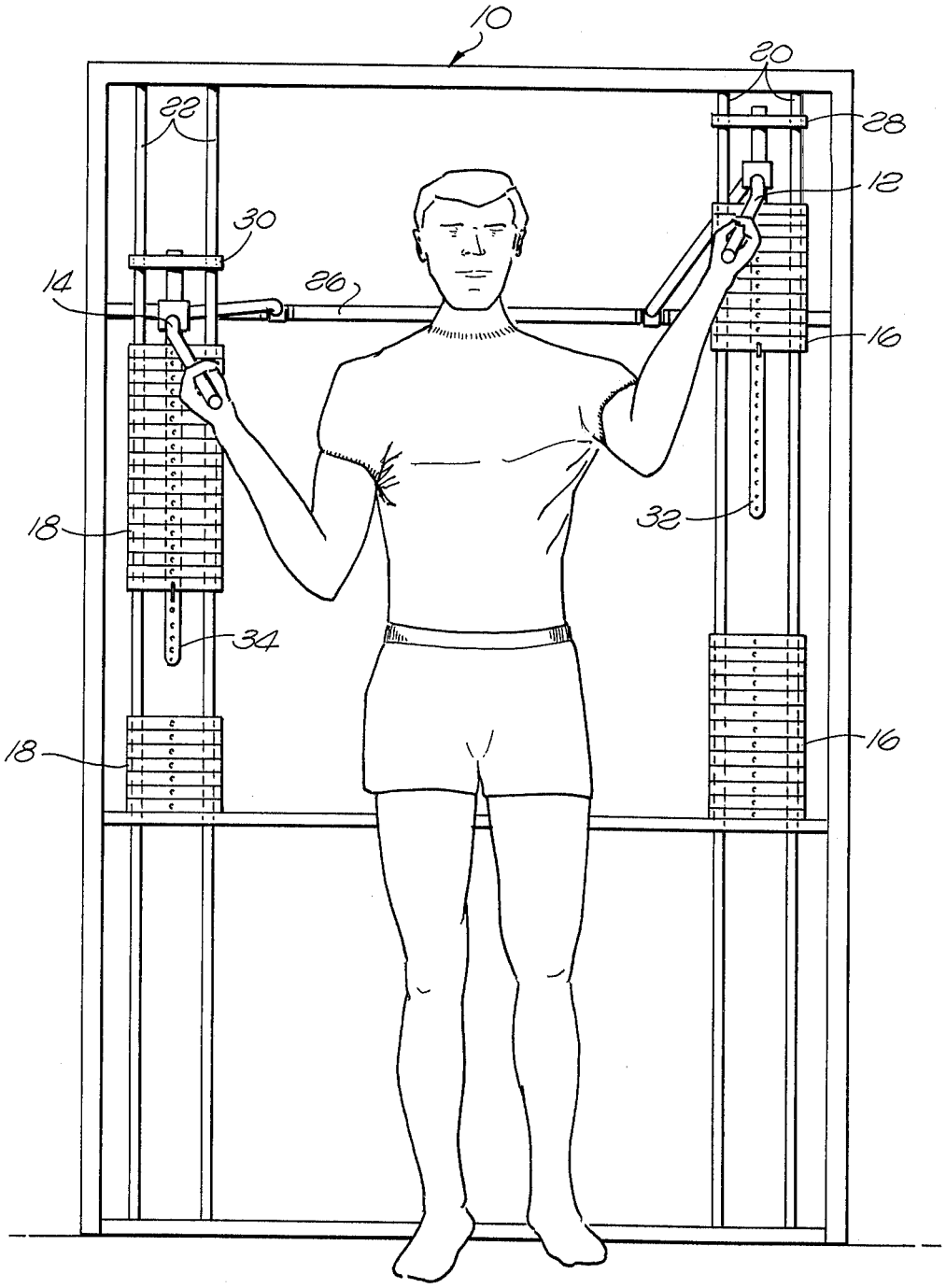
FIG. 1 is a schematic view of the present invention showing separate, simultaneous and independent movement of the lever arms.

As shown in FIG. 1, the present invention provides an exercise machine having a frame 10 and a plurality of separate and independent lever arms 12 and 14 which may be grasped by a user. The lever arms are pivotally connected to a frame cross bar 26. The device includes a pair of separate and independent stacks of weights 16 and 18 which are associated with lever arms 12 and 14, respectively. The stack 16 is slidably mounted on frame guide bars 20 and the stack 18 is slidably mounted on frame guide bars 22. Each lever arm is slidably mounted through a linear bearing sleeve, such as sleeve 24 shown in FIGS. 2 and 3, remote from the lever arm pivot points.

Each of the lever arms 12 and 14, as shown in FIG. 1, is associated with a housing 28 and 30, respectively, as will be described hereinafter in conjunction with FIGS. 2 and 3. Each housing has a pivotally connected selector bar 32 and 34, respectively, enabling a different number of weights from the associated weight stack to be connected to the housing.

Thus, for example, the user may select a larger number of weights from the stack 18 than from the stack 16, as is shown in FIG. 1. The user may lift the selected number of weights from the stack 16 in a separate and independent motion from lifting the weights selected from the stack 18. Alternatively, the use may lift both stacks simultaneously. This independent movement of the two limbs of the user, as shown in FIG. 1, combined with the ability to select different weights for each limb provides the substantial benefit of unilateral training as described above.

Figure 2:
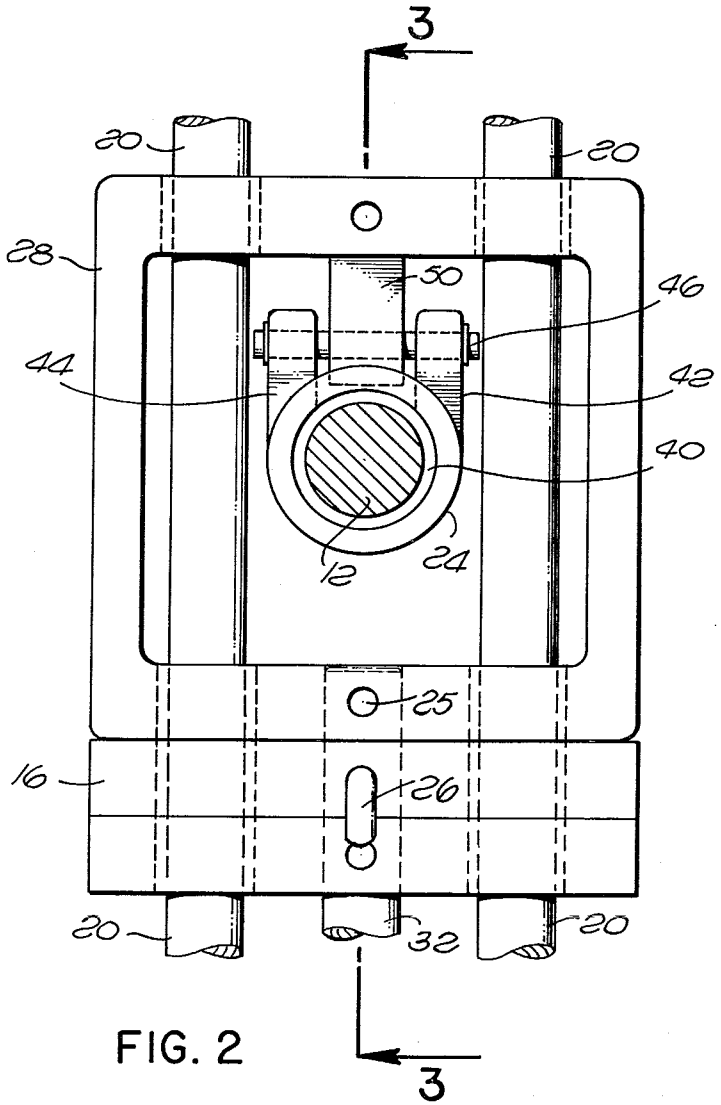
FIG. 2 is a cross-sectional, elevational view of the slidable connection between each lever arm with the associated weight stack; and, FIG. 3 is a cross-sectional, elevational view taken along the line 3—3 of FIG. 2.
Figure 3:
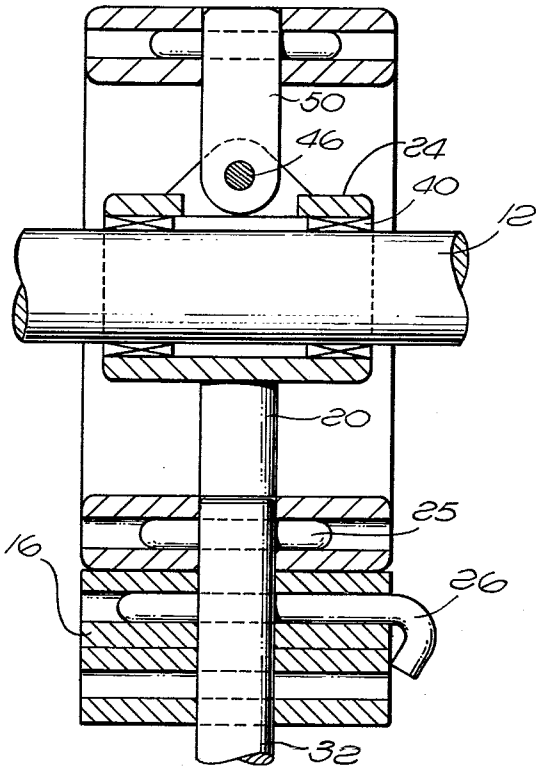

The housing 28, shown in greater detail in FIGS. 2 and 3, is slidably mounted in the guide bars 20 passing through vertical bores in the housing. The selector bar 32 is permanently attached to the housing lower plate by a roll pin 25 passing through aligned bores in the selector bar 32 and housing lower plate.

The weight stack 16 has a plurality of weights slidably mounted on guide bars 20 passing through vertical bores in the weights. A selector roll pin 26 is adapted to secure a predetermined number of the weights so the selector bar 32 by inserting the pin 26 through aligned horizontal bores in the bar and the selected one of the weights.

The sleeve 24 includes suitable low friction, annular bearings 40, composed of Teflon, nylon or the like. The sleeve is pivotally connected to an extension 50 of the housing by a clevis pin 46 passing through aligned horizontal bores in the ears 42 and 44 of the sleeve 24 and in the extension 50.

As the user raises the lever arm, the associated stack of weights is lifted vertically upward. This causes an increase in distance from the pivot point of the lever arm to the housing 28. This in turn increases the resistance against the force exerted by the user during the course of the exercise stroke. The device is constructed to provide a pattern of variation of resistance from the beginning to the end of the exercise stroke, in accordance with biomechanical research known in the art, to provide the maximum constant muscular force throughout the exercise stroke.

The clevis pin 46 extends slightly beyond both ears 42 and 44, as shown in FIG. 2, to accommodate a slight tolerance between the inner surfaces of the ears 42 and 44 and extension 50. The clevis pin 46 is thus adapted to permit a limited amount of lateral movement of the sleeve 24 with respect to the rear pivot point of the lever arm 12. This feature accommodates the slight lateral movement of the lever arm at the rear pivot point due to construction tolerances of the device. Any such lateral movement of the lever arm 12 would ordinarily cause bending of the clevis pin 46. This construction of the clevis pin 46, however, having a length which extends slightly beyond the ears 42 and 44, permits lateral movement of the sleeve 24 to maintain alignment of the lever arm 12 between the sleeve and the rear pivot point. This alignment of the lever arm 12 prevents bending of the clevis pin 46.

It will be apparent that various changes and modifications may be made in the disclosed embodiment, all within the scope of the invention as defined by the following claims.

We claim:

1. A dual function exercise machine, comprising:

a frame having means for guiding the movement of weights:

a plurality of separate and independent adjacent lever arm means pivotally connected to said frame for lifting separate stacks of weights by a user;

pivotable, linear bearing sleeve means for receiving each said lever arm means, each said sleeve means mounted at a position remote from each said lever arm means pivot point said each sleeve being mounted for linear movement with respect to said guide means and for simultaneous rotation with respect to said frame to maintain alignment with the respective lever arm means, each said sleeve means being adapted to simultaneously distribute lifting forces over a substantial length of each of the respective lever arm means;

bar means pivotally connected to said each linear bearing sleeve means;

a plurality of separate and independent stacks of weights, each stack of weights being slidably mounted for linear movement on said guide means and associated with one of said lever arm means; and, securing means adapted to secure each one of said bar means to a selected number of weights in an associated stack, said lever arm means being so situated on the frame as to permit exercise by one or both corresponding user's limbs on adjacent lever arm means connected to the same or a different number of weights and rotation by a user of said lever arm means causing rotation of an associated linear bearing sleeve means with said lever arm and simultaneous linear movement of said sleeve means and of said selected number of weights on said guide means.

2. The exercise machine as defined in claim 1, wherein said plurality of lever arm means comprises two lever arms and said plurality of weight stacks comprises a weight stack associated with each said lever arm means.

3. The exercise machine as defined in claim 1, wherein each of said lever arm means is secured to an associated weight stack to provide increased resistance during an exercise stroke.

4. The exercise machine as defined in claim 1, wherein each of said plurality of securing means includes a selector bar connected to a lever arm and passing through apertures in said weights and a pin adapted to connect a selected number of weights to the selector bar, said bar including a plurality of holes for receiving said pin, and further comprising:

a housing slidably mounted on said guide means and adapted to connect an associated linear bearing sleeve means to said bar means, said housing providing simultaneous distribution of the lifting forces over a longitudinal length of said guide means as said weights and housing are moved linearly on said guide means.

* * * * *